US011659913B2

(12) United States Patent
Tani

(10) Patent No.: US 11,659,913 B2
(45) Date of Patent: May 30, 2023

(54) APPLICATION CONTAINER WITH LEADING CYLINDER

(71) Applicant: TOKIWA CORPORATION, Nakatsugawa (JP)

(72) Inventor: Yoshikazu Tani, Kawaguchi (JP)

( * ) Notice: Subject to any disclaimer, the term of this patent is extended or adjusted under 35 U.S.C. 154(b) by 315 days.

(21) Appl. No.: 17/198,247

(22) Filed: Mar. 11, 2021

(65) Prior Publication Data

US 2021/0298455 A1 Sep. 30, 2021

(30) Foreign Application Priority Data

Mar. 24, 2020 (JP) ..... JP2020-052933

(51) Int. Cl.
*A45D 40/20* (2006.01)
*A45D 40/00* (2006.01)
*A45D 40/06* (2006.01)

(52) U.S. Cl.
CPC ..... *A45D 40/20* (2013.01); *A45D 40/06* (2013.01); *A45D 40/205* (2013.01); *A45D 2040/0012* (2013.01); *A45D 2040/208* (2013.01); *A45D 2200/05* (2013.01); *A45D 2200/1072* (2013.01)

(58) Field of Classification Search
CPC .. A45D 40/00; A45D 40/20; A45D 2040/201; A45D 2040/0012; A45D 2040/0006; A45D 2200/05; A45D 2200/10; A45D 40/205; A45D 2040/208; A45D 40/06; A45D 2200/1072
USPC ..... 401/261–265, 86, 87
See application file for complete search history.

(56) References Cited

U.S. PATENT DOCUMENTS

| | | | | |
|---|---|---|---|---|
| 9,044,078 | B2 * | 6/2015 | Tani | B05C 17/00516 |
| 10,485,323 | B2 | 11/2019 | Soga | |
| 2015/0257511 | A1 * | 9/2015 | Maurin | A45D 34/042 401/265 |
| 2016/0309881 | A1 | 10/2016 | Liu | |
| 2017/0295907 | A1 | 10/2017 | Yasumi | |
| 2018/0303219 | A1 | 10/2018 | Sasaki | |
| 2019/0059556 | A1 | 2/2019 | Tani | |

FOREIGN PATENT DOCUMENTS

| | | |
|---|---|---|
| JP | H10-174617 | 6/1998 |
| JP | 2001-204544 | 7/2001 |
| JP | 2001-218621 | 8/2001 |
| JP | 2008-036071 | 2/2008 |
| JP | 2017-189466 | 10/2017 |

(Continued)

*Primary Examiner* — David J Walczak
(74) *Attorney, Agent, or Firm* — Soei Patent & Law Firm

(57) ABSTRACT

An application container includes a leading cylinder that internally contains an application material, and has an opening through which the application material is exposed. The opening extends in a major axis direction, and has a minor axis direction. The leading cylinder has a front edge curved to bulge to an outside of the leading cylinder from a tip located on one side in the major axis direction toward the other side. When viewed from the other side, the opening extends rearward from the tip in a slit shape. A first application material holder located on both sides of the opening in the minor axis direction is formed in a tip portion of the leading cylinder having an outer surface extending rearward while being curved to bulge to the outside of the leading cylinder from the tip.

7 Claims, 13 Drawing Sheets

(56) References Cited

FOREIGN PATENT DOCUMENTS

| | | |
|---|---|---|
| JP | 2018-202144 | 12/2018 |
| JP | 2019-037382 | 3/2019 |
| JP | 2019-058658 | 4/2019 |

* cited by examiner

APPLICATION CONTAINER WITH LEADING CYLINDER

CROSS-REFERENCE TO RELATED APPLICATIONS

This application claims the benefit of priority from Japanese Patent Application No. 2020-052933, filed on Mar. 24, 2020, the entire contents of which are incorporated herein by reference.

BACKGROUND

In the related art, various application containers for containing application materials are known. Japanese Unexamined Patent Publication No. 2019-37382 discloses an application material feeding container for feeding a solid application material. The application material feeding container includes a leading cylinder forming a container front portion and a container main body forming a container rear portion. The leading cylinder has an elongated cylindrical shape extending in an axial direction in which an axis of the application material feeding container extends.

A front end portion of the leading cylinder has a leading cylinder inclined surface inclined with respect to the axial direction. An opening portion through which the application material is exposed is formed in the front end portion of the leading cylinder. The leading cylinder inclined surface is inclined obliquely rearward from a front end of the leading cylinder. The opening portion has a shape in which one side of a side surface of the leading cylinder is cut out, and extends obliquely rearward from the front end of the leading cylinder. The application material has a shape extending in a major axis direction intersecting with the axial direction and in a minor axis direction intersecting with both the axial direction and the major axis direction. In addition, the application material has a tip extending along the major axis direction and an application material inclined surface extending obliquely rearward from the tip.

SUMMARY

In some types of application material feeding containers, the application material has the tip extending along the major axis direction. Accordingly, the tip of the application material can be applied to an application target portion of skin to draw a thin line. However, when a flat and solid application material is thinned to draw the thin line with the application material, there is a possibility that the application material may be broken. For example, when the application is performed with a thin application material, there is a possibility that the application material may be broken or collapsed. In addition, when a tip portion of the leading cylinder holding the application material is thinned, a curvature of the tip portion becomes large (radius of curvature becomes small). Therefore, when the portion having the large curvature of the tip portion comes into contact with the skin of a user, there is a possibility that the user may feel discomfort.

An example application container disclosed herein may be configured to prevent breakage of an application material and to reduce the discomfort felt by the user.

The application container may be configured to cause a flat and solid application material to be exposed in a forward direction. The application container includes a leading cylinder internally containing the application material, and has an opening through which the application material is exposed. When viewed from the front, the opening extends in a major axis direction intersecting with an axial direction which is an extending direction of an axis of the leading cylinder, and has a minor axis direction intersecting with both the axial direction and the major axis direction. The leading cylinder has a front edge curved to bulge to an outside of the leading cylinder from a tip of the leading cylinder located on one side in the major axis direction toward the other side in the major axis direction and a rear side when viewed in the minor axis direction. When viewed from the other side in the major axis direction, the opening extends rearward from the tip in a slit shape. When viewed from the other side in the major axis direction, a first application material holder located on both sides of the opening in the minor axis direction is formed in a tip portion of the leading cylinder having an outer surface extending rearward while being curved to bulge to the outside of the leading cylinder from the tip.

The application container includes the leading cylinder that contains the flat and solid application material. Therefore, a thin line can be drawn by the flat application material. The opening of the leading cylinder extends in the major axis direction and the minor axis direction. The leading cylinder has the front edge curved to bulge to the outside of the leading cylinder from the tip located on one side in the major axis direction toward the other side in the major axis direction and the rear side. Therefore, the front edge is curved to bulge in order to reduce discomfort felt by a user when the front edge comes into contact with skin. When viewed from the other side in the major axis direction, the opening extends rearward in the slit shape from the tip. Therefore, since the application material is exposed from the opening extending in the slit shape, a thin line can be readily drawn by the application material. In addition, the first application material holder is formed on both sides in the minor axis direction of the slit-shaped opening. Therefore, the application material exposed from the slit-shaped opening can be held by the first application material holder from both sides in the minor axis direction in order to prevent the breakage of the flat application material. In addition, each of the first application material holders extends rearward while being curved to bulge to the outside of the leading cylinder from the tip of the leading cylinder in order to reduce the discomfort felt by the user when the first application material holder comes into contact with the skin.

The application container may include a second application material holder located on one side in the major axis direction of the opening extending in a slit shape. In some examples, the application material can be held by the second application material holder from one side in the major axis direction in order to more reliably prevent the breakage of the application material.

A length in the axial direction of the opening when viewed from the other side in the major axis direction may be equal to or longer than a length in the major axis direction of the opening when viewed from the front. In some examples, the length of the application material exposed to the side of the leading cylinder from the slit-shaped opening is long. Accordingly, a thin line can be readily drawn by inclining the application container. For example, in the opening extending rearward in the slit shape from the tip of the leading cylinder, the length of the opening when viewed from the other side in the major axis direction is equal to or longer than the length of the opening when viewed from the front. Accordingly, a thin line can be freely drawn while the application container is inclined by laying down or erecting the application container. In addition, a thin line can be freely drawn even in a state where the application container is inclined with respect to an application target portion. Accordingly, the thin line can be readily drawn at various inclination angles.

The leading cylinder may have a body portion having a tapered surface that extends rearward from the tip portion and is inclined so that a width of the leading cylinder increases rearward when viewed in the minor axis direction. When viewed in the minor axis direction, an average inclination angle of the tapered surface located on the other side in the major axis direction with respect to the axis may be larger than an average inclination angle of the tapered surface located on the one side in the major axis direction with respect to the axis. In some examples, the average inclination angle of the tapered surface on the opening side extending in the slit shape is large. Therefore, the application material exposed from the opening provided along the tapered surface having the large average inclination angle is applied to the application target portion. Accordingly, a thin line can be readily drawn while the application container is inclined.

A center position of the opening when viewed from the front may be biased (e.g., shifted or repositioned) from the axis to the other side in the major axis direction. In some examples, the opening extending in the slit shape is biased to the other side in the major axis direction. Accordingly, a thin line can be readily drawn by the application material exposed from the opening.

The leading cylinder may have a body portion having a tapered surface that extends rearward from the tip portion and is inclined so that a width of the leading cylinder increases rearward, and the tapered surface may include a recess portion that is curved to be recessed. In some examples, since the tapered surface includes the recess portion, a portion of the body portion can be thinned. Accordingly, the body portion can be less likely to interfere with a line of sight of a user when the application is performed. In addition, the body portion may include the recess portion on the tapered surface. Accordingly, a wall thickness of the leading cylinder can be approximately constant in order to prevent a sink mark that may occur when the leading cylinder is molded.

The recess portion may be curved to be recessed when the leading cylinder is viewed along the major axis direction. In some examples, the recess portion is visible in a state of being recessed when the leading cylinder is viewed along the major axis direction. Accordingly, a user can readily recognize the minor axis direction of the leading cylinder. Therefore, the user can feel that the application container is easy to hold. Accordingly, usability of the application container can be improved.

As discussed in further detail below, the various example application containers disclosed herein may be configured to prevent breakage of an application material, and to reduce discomfort felt by a user.

DETAILED DESCRIPTION

In the following description, with reference to the drawings, the same reference numbers are assigned to the same components or to similar components having the same function, and overlapping description is omitted.

Figure 1:
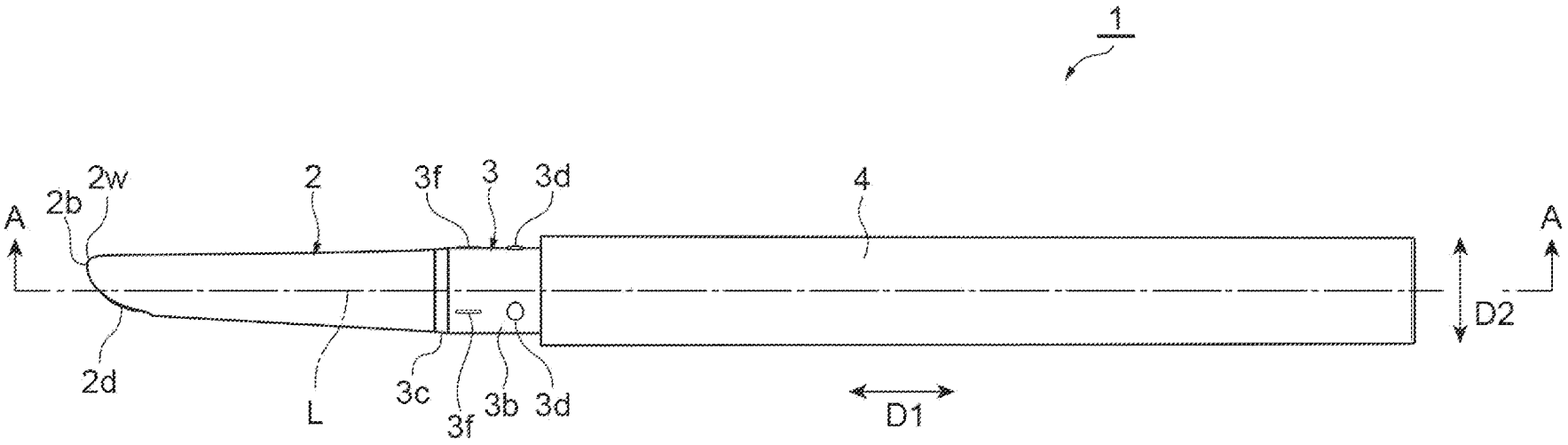
FIG. 1 is a side view illustrating an example application container when viewed in a minor axis direction.

FIG. 1 is a side view illustrating an example application container 1. As illustrated in FIG. 1, the application container 1 has a rod shape extending along an axial direction D1. In the present disclosure, an "axis" indicates a central axis of a leading cylinder of the application container, and an "axial direction" indicates a direction in which the axis of the leading cylinder of the application container extends and a direction in which the application material moves forward. For example, the "axial direction" coincides with a longitudinal direction of the application container 1.

A cap is freely attachable to and detachable from the application container 1, and FIG. 1 illustrates a state where the cap is detached. In a state where the cap is detached, as an external configuration, the application container 1 includes a leading cylinder 2, a middle cylinder 3, and a container main body 4. Hereinafter, a direction in which the leading cylinder 2 is provided when viewed from the container main body 4 will be referred to as "forward", and a direction in which the container main body 4 is provided when viewed from the leading cylinder 2 will be referred to as "rearward" in the description. However, the directions are set for convenience of description, and the directions are not particularly limited.

Figure 2:
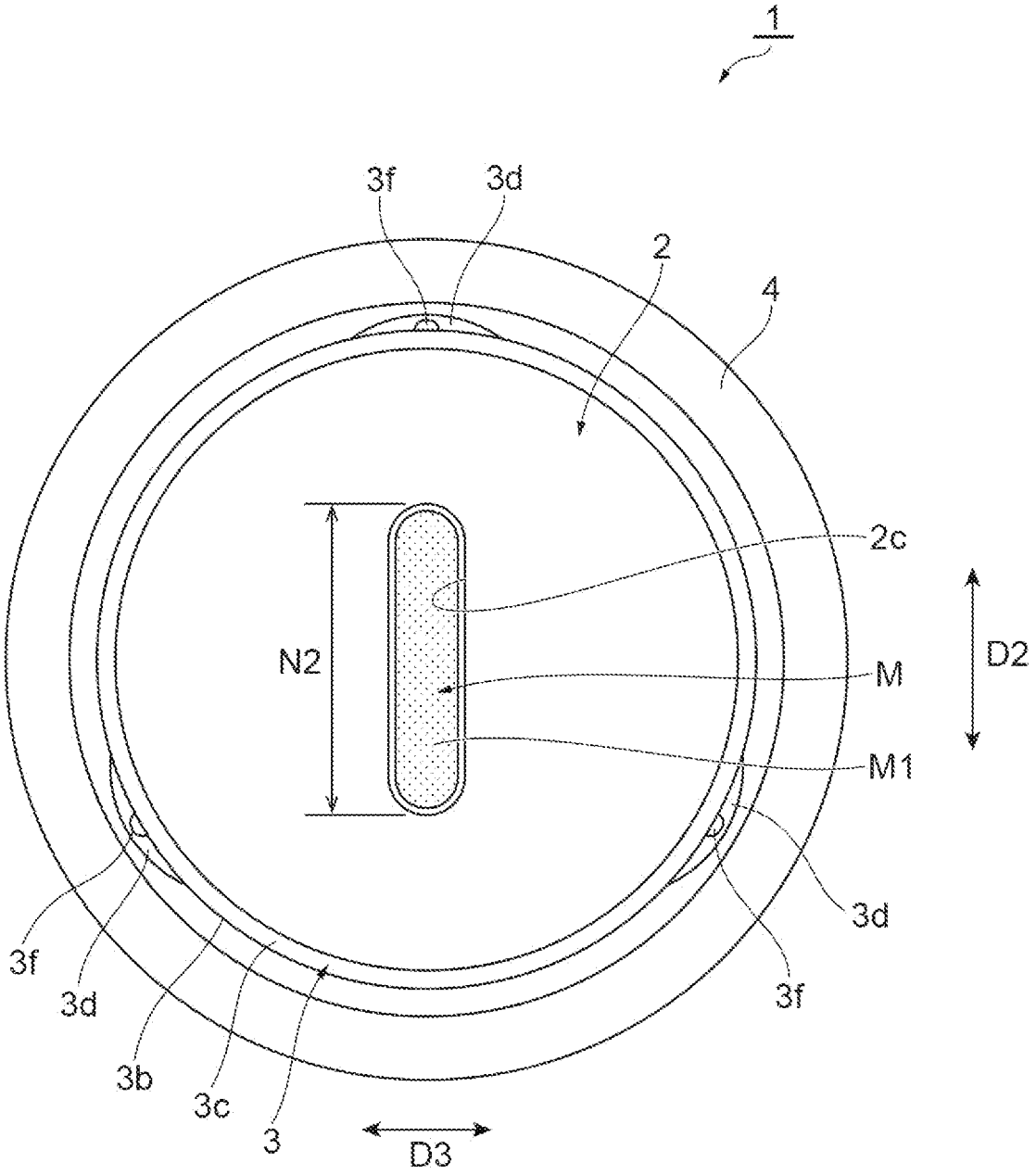
FIG. 2 is a front view of the application container in FIG. 1.

FIG. 2 is a front view when the application container 1 is viewed from the front. As illustrated in FIGS. 1 and 2, for example, the application container 1 is a pencil that feeds (extrudes) an internally contained application material M. The leading cylinder 2 has an elongated cylindrical shape extending in the axial direction D1. As an example, the leading cylinder 2 is molded of an ABS resin (copolymerized synthetic resin of acrylonitrile, butadiene, and styrene).

The leading cylinder 2 has an opening 2*c* through which the application material M is exposed. The application material M is flat and solid. For example, the application material M is a plate-shaped cosmetic material, but may be a plate-shaped drawing material. In some examples, the application material M may be an eyebrow liner, and the application container 1 may be an eyebrow feeding container.

The opening 2*c* has a flat shape extending in a major axis direction D2 intersecting with the axial direction D1 and a minor axis direction D3 intersecting with both the axial direction D1 and the major axis direction D2. For example, the axial direction D1, the major axis direction D2, and the minor axis direction D3 are orthogonal to one another. When viewed in the minor axis direction D3, the leading cylinder 2 has a tip 2*b* located on one side (upper side in FIG. 1) in the major axis direction D2.

When viewed in the minor axis direction D3 (direction orthogonal to a paper surface in FIG. 1), the leading cylinder 2 has a front edge 2*d* curved to bulge to an outside of the leading cylinder 2 from a tip 2*b* located on one side in the major axis direction D2 toward the other side (lower side in FIG. 1) and a rear side in the major axis direction D2. In the present disclosure, the description "curved to bulge to the outside" indicates an aspect in which the front edge is curved to the outside of a certain object from a straight line connecting two points of the object. For example, the description indicates a portion whose rotation center is located inside the object and which bulges in a curve shape. In some examples, the front edge 2*d* may include a curve whose rotation center is located inside the leading cylinder 2 and whose radius of curvature is gradually changed.

As an example, the middle cylinder 3 is molded of polyacetal (POM), and is formed in a substantially cylindrical shape. The middle cylinder 3 engages with the leading cylinder 2 in the axial direction D1 on a rear side of the leading cylinder 2. The middle cylinder 3 has an outer peripheral surface 3*b* extending in the axial direction D1, an inclined surface 3*c* located on a front side of the outer peripheral surface 3*b*, a first projection portion 3*d* projecting on the outer peripheral surface 3*b*, and a second projection portion 3*f* projecting forward of the first projection portion 3*d* of the outer peripheral surface 3*b*.

The inclined surface 3*c* is a tapered surface inclined so that a diameter of the middle cylinder 3 decreases forward. For example, the middle cylinder 3 includes a plurality of the first projection portions 3*d* and a plurality of the second projection portions 3*f* As an example, each number of the first projection portions 3*d* and the number of the second projection portions 3*f* is 3. For example, the three first projection portions 3*d* are disposed at an equal interval along a circumferential direction of the middle cylinder 3, and the three second projection portions 3*f* are disposed at an equal interval along the circumferential direction of the middle cylinder 3. For example, a shape of the first projection portion 3*d* when viewed from the outside in a radial direction of the middle cylinder 3 is a circular shape, and a shape of the second projection portion 3*f* when viewed from the outside in the radial direction of the middle cylinder 3 is a straight line shape extending in the axial direction D1. The above-described cap covering the leading cylinder 2 engages with the first projection portion 3*d* and the second projection portion 3*f*.

Figure 3:
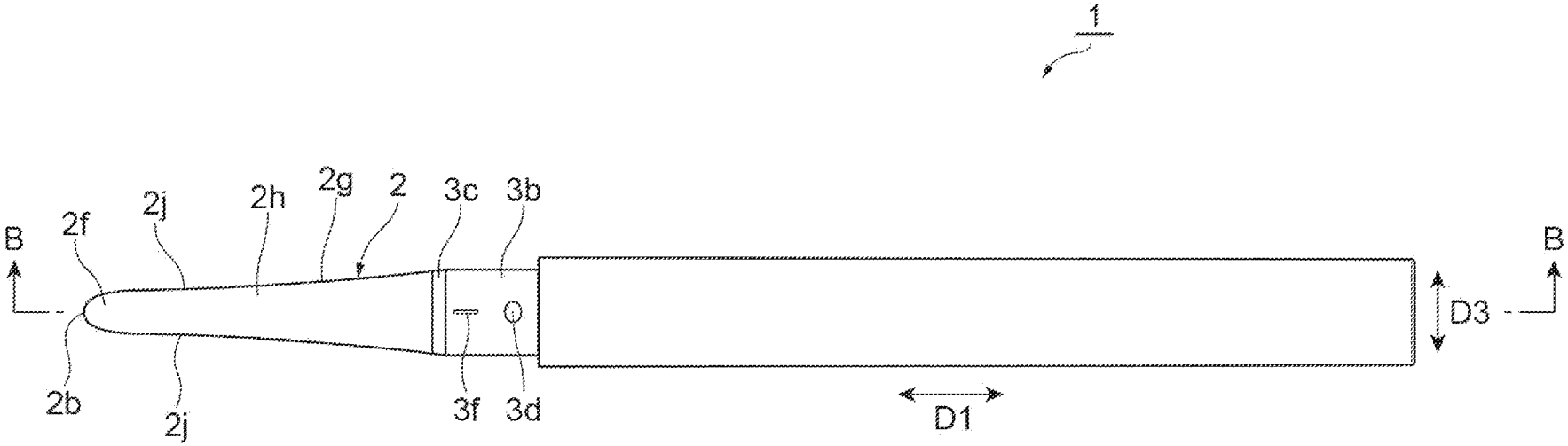
FIG. 3 is a side view of the application container in FIG. 1 when viewed in a major axis direction.

FIG. 3 is a side view when the application container 1 is viewed from one side (tip 2*b* side) in the major axis direction D2. As illustrated in FIG. 3, when viewed from one side in the major axis direction D2, the leading cylinder 2 has a tip portion 2*f* curved to bulge forward toward the tip 2*b*, and a body portion 2*h* having a tapered surface 2*g* extending rearward from the tip portion 2*f* In the present disclosure, the "tip portion" indicates a prescribed region on the front side of the leading cylinder which includes the tip, and for example, indicates a portion curved in a curve shape from a front end of the tapered surface.

In some examples, the tip portion 2*f* is curved to bulge forward from a front end of the tapered surface 2*g* toward the tip 2*b*. For example, the tip portion 2*f* may include a curve whose radius of curvature gradually decreases forward. The tapered surface 2*g* of the body portion 2*h* is an outer peripheral surface of the leading cylinder 2 which is inclined so that the leading cylinder 2 is gradually thickened rearward from the tip portion 2*f*.

When the leading cylinder 2 is viewed along the major axis direction D2, the tapered surface 2*g* of the leading cylinder 2 has a recess portion 2*j* recessed so that a width of the body portion 2*h* is narrowed. For example, the recess portion 2*j* indicates a portion slightly recessed on a front side of the leading cylinder 2. For example, the leading cylinder 2 includes a pair of the recess portions 2*j* aligned along the minor axis direction D3. However, an aspect of the recess portion of the leading cylinder is not limited to the recess portion 2*j*, and for example, may be a recess portion formed in an annular shape on an entire periphery of the leading cylinder 2.

Figure 4:
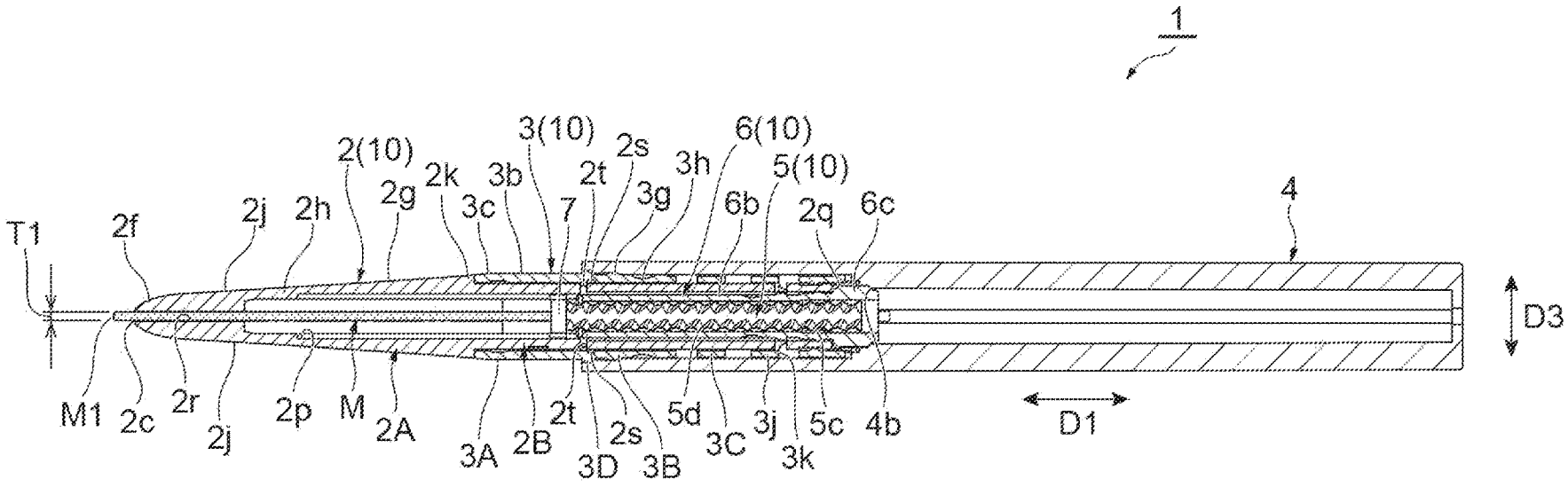
FIG. 4 is a sectional view of the application container in FIG. 1 taken along line A-A.
Figure 5:
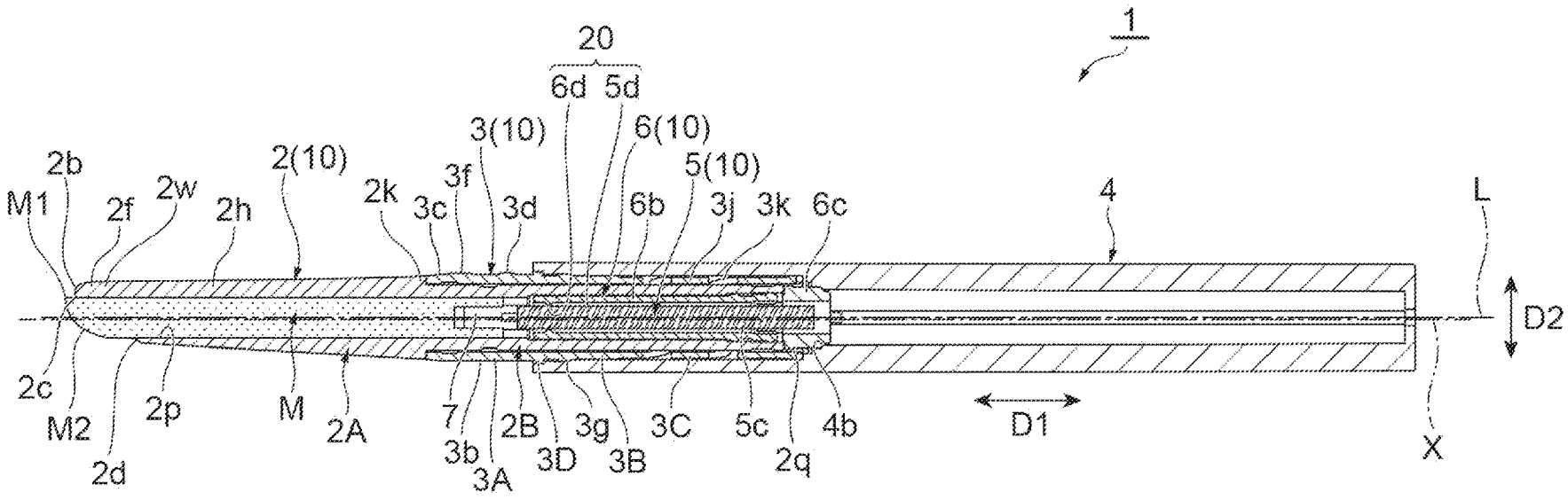
FIG. 5 is a sectional view of the application container in FIG. 3 taken along line B-B.

FIG. 4 is a sectional view taken along line A-A in FIG. 1. FIG. 5 is a sectional view taken along line B-B in FIG. 3. As illustrated in FIGS. 4 and 5, the application container 1 includes a leading cylinder 2 that forms the above-described container front portion, a middle cylinder 3, a container main body 4 forming a container rear portion, a moving body 5 accommodated inside the container main body 4, a holding member 6 that holds the moving body 5 inside the container main body 4, and an application material holder 7 that holds the application material M on a front side of the moving body 5.

In some examples, the leading cylinder 2, the middle cylinder 3, the moving body 5, and the holding member 6 form a feeding mechanism 10 that feeds the application material M forward. As described above, the application material M may have a plate shape. For example, the application material M has a front end M1 and a curved portion M2 that bulges to the outside of the application material M from the front end M1 toward the other side in the major axis direction D2 and a rear side.

For example, a thickness T1 of the application material M in the minor axis direction D3 is 0.4 mm to 2.0 mm. In addition, a lower limit of the thickness T1 may be 0.6 mm, 0.7 mm, or 0.8 mm, and an upper limit of the thickness T1 may be 0.9 mm or 1.5 mm. For example, the thickness T1 of the application material M may be thinner than that of the application material in the related art. Accordingly, a thin line can be readily drawn. A value of the thickness T1 is not limited to the above-described example, and can be changed as appropriate.

The leading cylinder 2 includes a front side cylindrical portion 2A having the front edge 2*d*, the tip portion 2*f*, and the body portion 2*h*, and a rear side cylindrical portion 2B located behind the front side cylindrical portion 2A. The front side cylindrical portion 2A is a portion exposed to the outside of the application container 1, and the rear side cylindrical portion 2B is a portion inserted into the middle cylinder 3 from the front. The front side cylindrical portion 2A has a step portion 2*k* extending from a rear end of the front side cylindrical portion 2A in a direction in which a diameter of the leading cylinder 2 decreases. The diameter of the front side cylindrical portion 2A increases from the step portion 2*k* with respect to the rear side cylindrical portion 2B, and the diameter gradually decreases forward from the step portion 2*k*.

For example, a front end of the middle cylinder 3 faces a rear surface of the step portion 2*k*. The rear side cylindrical portion 2B serves as an insertion portion inserted into the middle cylinder 3. The leading cylinder 2 engages with the middle cylinder 3 in the axial direction D1 to be relatively rotatable by inserting the rear side cylindrical portion 2B located on a rear side of the step portion 2*k* into the middle cylinder 3.

The rear side cylindrical portion 2B includes a pair of elastic protruding portions 2*s* aligned along the radial direction (for example, the minor axis direction D3) of the leading cylinder 2. The elastic protruding portion 2*s* is a portion that comes into contact with an inner peripheral surface of the middle cylinder 3 by using an elastic force, and is provided to protrude outward in the radial direction of the leading cylinder 2. A notch 2*t* that communicates with the inside and the outside of the leading cylinder 2 is formed around the elastic protruding portion 2*s*, and the notch 2*t* allows the elastic protruding portion 2*s* to be elastic in the radial direction of the leading cylinder 2.

Inside the front side cylindrical portion 2A, a containing space 2*p* that contains the application material M extends along the axial direction D1. For example, the leading cylinder 2 has an application material insertion portion 2*r* on a front side of the containing space 2*p*. The application material insertion portion 2*r* extends in the axial direction D1 between the containing space 2*p* and the opening 2*c*. The length of the containing space 2*p* in the minor axis direction D3 is longer than the length of the application material insertion portion 2*r* in the minor axis direction D3. For example, the recess portion 2*j* included in the tapered surface 2*g* may be provided outside the application material insertion portion 2*r* in which the leading cylinder 2 is thicker than the containing space 2*p*. In some examples, the wall thickness of the leading cylinder 2 can be approximately uniform.

A second application material holder 2*w* that holds the application material M is provided on one side of the opening 2*c* in the major axis direction D2. The second application material holder 2*w* will be described in detail later. In addition, a central axis X of the opening 2*c* is biased from an axis L to the other side (lower side in FIG. 5) in the major axis direction D2. That is, a center position of the opening 2*c* when the opening 2*c* is viewed along the axial direction D1 is biased from the axis L to the other side in the major axis direction D2. Since the center position of the opening 2*c* is biased to the other side in the major axis direction D2 in this way, for example, the second application material holder 2*w* located on one side in the major axis direction D2 is relatively thickened.

The middle cylinder 3 includes a front side cylindrical portion 3A, a rear side cylindrical portion 3B, and a spring portion 3C in this order from the front end to the rear end. The front side cylindrical portion 3A includes the outer peripheral surface 3*b*, the inclined surface 3*c*, the first projection portion 3*d*, and the second projection portion 3*f* which are described above. The spring portion 3C of the middle cylinder 3 protects the application container 1 and the application material M by cushioning an internally transmitted impact when an external force is applied such as when the application container 1 is dropped. For example, the spring portion 3C has a function of screwing back the screw portion 20 for attaching the moving body 5 to the holding member 6 when a clutch is rotated in a rearward movement limit of the application material M.

A flange portion 3D is provided between the front side cylindrical portion 3A and the rear side cylindrical portion 3B. The flange portion 3D protrudes outward in the radial direction of the middle cylinder 3 and enters the front end of the container main body 4. An annular projection 3*g* and a recess portion 3*h* are provided on the outer peripheral surface of the rear side cylindrical portion 3B. For example, when the middle cylinder 3 is manufactured by means of molding, an injection port for injecting a material such as a resin into a molding die is disposed in the center of the recess portion 3*h*.

The spring portion 3C is provided behind the annular projection 3*g* and the recess portion 3*h*. The spring portion 3C is a resin spring that can be expanded and contracted in the axial direction D1. The spring portion 3C is formed by a main body portion 3*j* and a slit 3*k* that spirally extends along a peripheral surface of the main body portion 3*j* and communicates with the inside and the outside of the main body portion 3*j*. The spring portion 3C is contracted to cushion the impact when the external force is applied.

For example, the moving body 5 is formed of polybutylene terephthalate (PBT), and is formed in a round bar shape. The moving body 5 includes a shaft 5*c* extending along a longitudinal axis of the moving body 5. The shaft 5*c* extends rearward from the application material holder 7. A male screw 5*d* forming one screw portion 20 is formed on an outer surface of the shaft 5*c*.

For example, the male screw 5*d* is formed in the whole shaft 5*c* in the axial direction D1. For example, the moving body 5 engages with the application material holder 7 in the axial direction D1. In addition, for example, a groove formed in the moving body 5 engages with a ridge formed on the inner surface of the leading cylinder 2. In this manner, the moving body 5 engages with the leading cylinder 2 in a rotational direction (circumferential direction).

For example, the holding member 6 is formed of POM, and is formed in a substantially cylindrical shape. The holding member 6 includes a front side cylindrical portion 6*b* extending from a front end thereof in the axial direction D1 and a rear side cylindrical portion 6*c* whose diameter increases behind the front side cylindrical portion 6*b*. A spiral projection 6*d* forming the other side of the screw portion 20 is formed on an inner surface of the front side cylindrical portion 6*b*. The rear side cylindrical portion 6*c* is pinched in the axial direction D1 between an inner wall 4*b* of the container main body 4 and a rear end 2*q* of the leading cylinder 2.

In some examples, when the leading cylinder 2 is rotated relative to the middle cylinder 3, the moving body 5 that rotates synchronously with respect to the leading cylinder 2 and the holding member 6 that rotates synchronously with respect to the middle cylinder 3 and the container main body 4 rotate relative to each other in one direction. The relative rotation causes a screwing action to work in the screw portion 20 configured to include a male screw 5*d* of the moving body 5 and the projection 6*d* of the holding member 6.

The moving body 5 is moved forward from the holding member 6 by the above-described screwing action, and the moving body 5 and the application material holder 7 slide with respect to the leading cylinder 2. In this way, when the moving body 5 and the application material holder 7 move forward to the leading cylinder 2, the application material M appears from the opening 2*c* of the tip portion 2*f* of the leading cylinder 2, thereby bringing the application material M into a useable state.

Figure 6A:
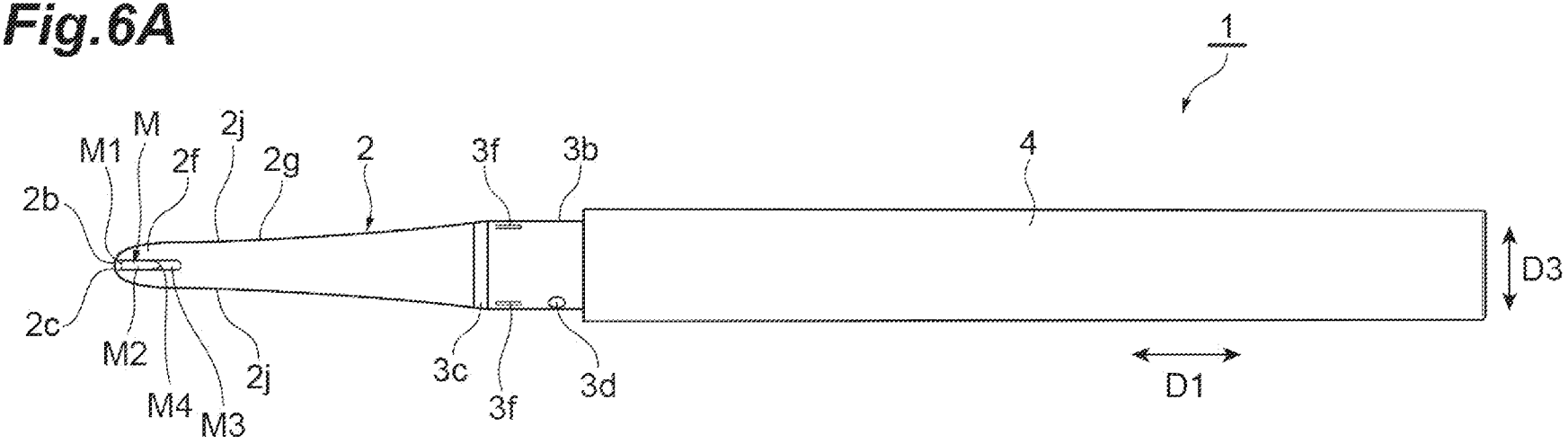
FIG. 6A is a side view of the application container in FIG. 1 when viewed from an opposite side in the major axis direction.
Figure 6B:
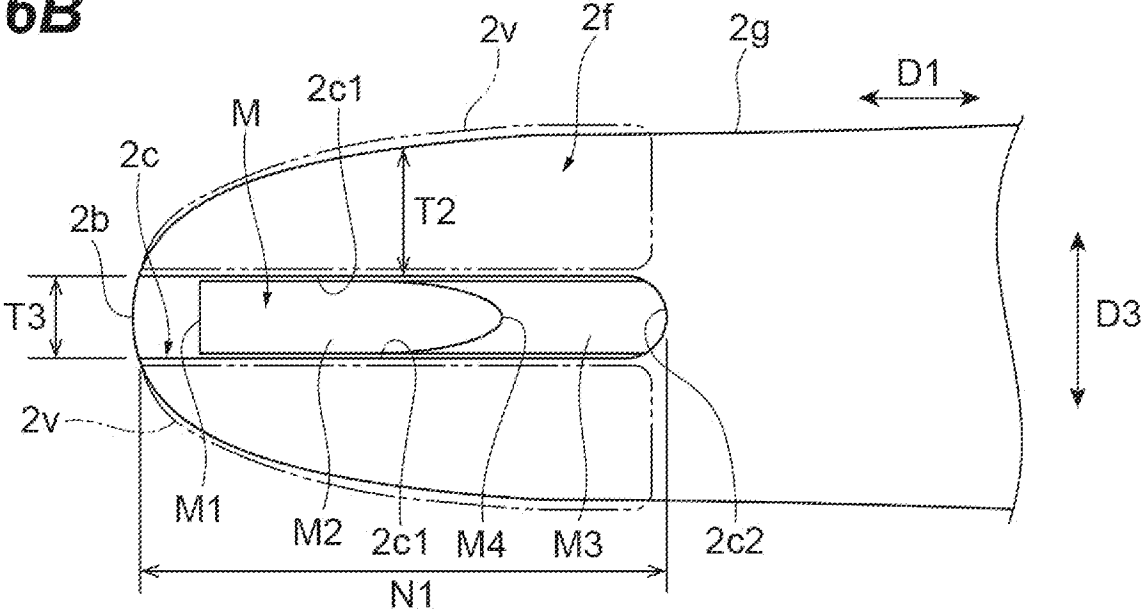
FIG. 6B is an enlarged view of a tip portion of the application container in FIG. 6A.
Figure 7:
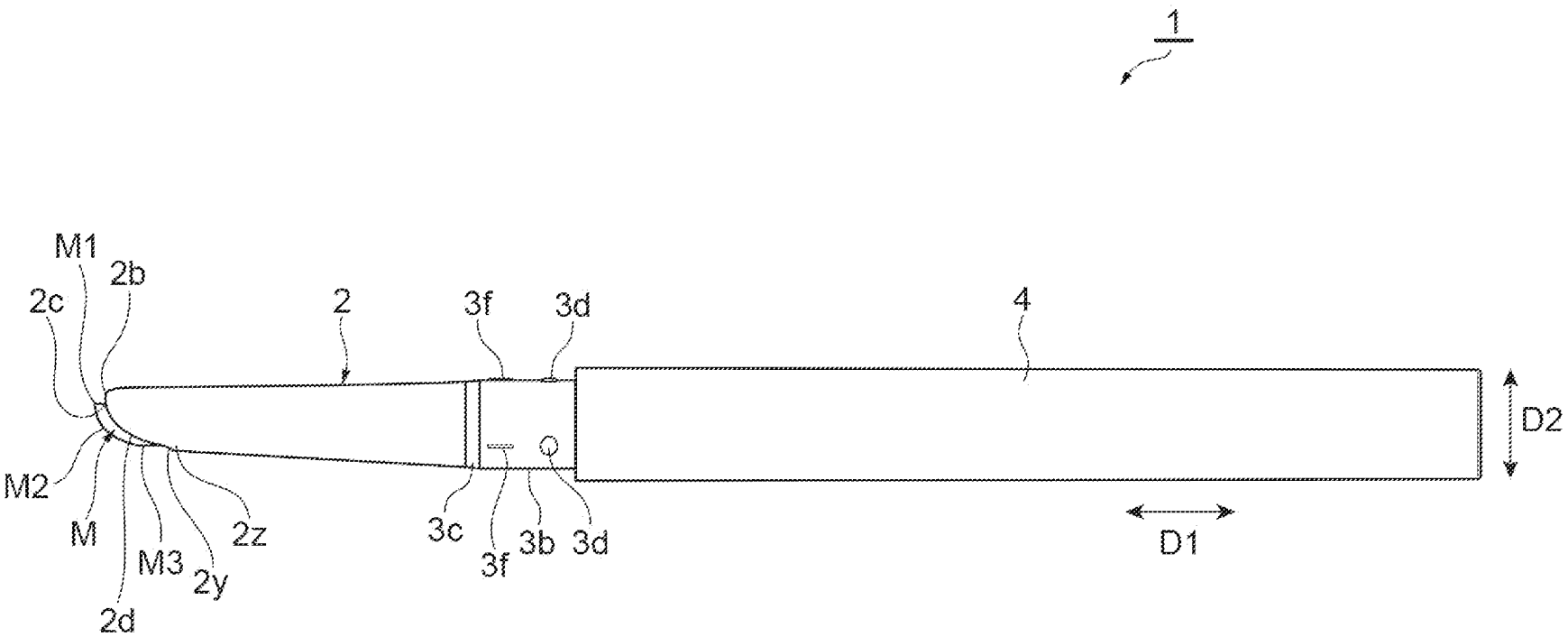
FIG. 7 is a side view illustrating an application material exposed from the application container in FIG. 1.

Next, the leading cylinder 2 and the application material M will be described in more detail. FIG. 6A is a side view when the application container 1 is viewed from the other side (side opposite to the application container 1 in FIG. 3) in the major axis direction D2. FIG. 6B is an enlarged side view of the tip portion 2*f* of the leading cylinder 2 in FIG. 6A. FIG. 7 is a side view when the application container 1 from which the application material M protrudes is viewed in the minor axis direction D3.

As illustrated in FIGS. 6A, 6B, and 7, the opening 2*c* of the leading cylinder 2 extends rearward in a slit shape from the tip 2*b* when viewed from the other side in the major axis direction D2. That is, in a side view, the opening 2*c* linearly extends along the axial direction D1. As illustrated in FIGS. 2, 6A, 6B, and 7, the opening 2*c* has a shape formed along the front edge 2*d*, for example. That is, the opening 2*c* is curved to bulge to the outside of the leading cylinder 2 from the tip 2*b* toward the other side (lower side in FIG. 7) and the rearward side in the major axis direction D2.

When viewed in the minor axis direction D3, the opening 2*c* and the curved portion M2 of the application material M may be parallel to each other. That is, the application material M is disposed so that the curved portion M2 is formed along the opening 2*c* and the front edge 2*d*. In this case, a long application portion of the application material M can be secured as the curved portion M2. Accordingly, a thin line can be readily drawn on an application target portion such as the skin by bringing any desired portion of the curved portion M2 into contact with the application target portion while the leading cylinder 2 is inclined.

For example, the leading cylinder 2 has a recess portion 2*y* recessed inward of the leading cylinder 2 on a rear side of the front edge 2*d*, and a projection portion 2*z* located between the recess portion 2*y* and the tapered surface 2*g* of the leading cylinder 2. A length N1 of the opening 2*c* in a side view is equal to or longer than a length N2 of the opening 2*c* in the major axis direction D2 when viewed from the front. For example, a laterally projected area of the opening 2*c* is equal to or larger than a forward projected area of the opening 2*c*.

In the present disclosure, the term "lateral" indicates a direction that intersects with the axial direction, and for example, indicates an extending direction of a plane intersecting with (as an example, orthogonal to) the axial direction D1. In some examples, the term "lateral" indicates a direction intersecting with the axial direction D1, and includes the major axis direction D2 and the minor axis direction D3.

In a side view of the leading cylinder 2 (when viewed from the other side in the major axis direction D2), the opening 2*c* is defined by a pair of side portions 2*c*1 linearly extending along the axial direction D1 and a connection portion 2*c*2 that connects the pair of side portions 2*c*1 to each other in a rear end of the pair of side portions 2*c*1. In addition, the application material M includes a side surface portion M3 located behind the curved portion M2 and a boundary portion M4 located between the curved portion M2 and the side surface portion M3.

Each side portion 2*c*1 of the opening 2*c* extends rearward from the tip 2*b* of the leading cylinder 2, and the connection portion 2*c*2 is curved to bulge rearward from a rear end of the side portion 2*c*1. For example, the front end M1, the curved portion M2, the side surface portion M3, and the boundary portion M4 of the application material M are exposed from the opening 2*c*. For example, the side surface portion M3 has a curved surface shape curved to bulge in the major axis direction D2. The boundary portion M4 has a curve shape curved to bulge rearward in the rear end of the curved portion M2.

A first application material holder 2*v* that holds the application material M in the minor axis direction D3 is provided in each of one side and the other side of the opening 2*c* in the minor axis direction D3. For example, the first application material holder 2*v* is provided in the tip portion 2*f* of the leading cylinder 2 described above and a front side portion of the tapered surface 2*g*. Each first application material holder 2*v* extends rearward while being curved to bulge to the outside of the leading cylinder 2 from the tip 2*b* of the leading cylinder 2.

For example, the pair of first application material holders 2*v* aligned along the minor axis direction D3 are disposed to be mutually symmetrical with respect to the opening 2*c*. When viewed from the other side in the major axis direction D2, for example, the first application material holder 2*v* has a parabolic shape. However, a shape of the first application material holder 2*v* is not limited to the parabolic shape. A thickness of the first application material holder 2*v* gradually increases rearward. For example, a thickness T2 of the first application material holder 2*v* in the center of the opening 2*c* in the axial direction D1 is thicker than a length T3 of the opening 2*c* in the minor axis direction D3.

Figure 8:
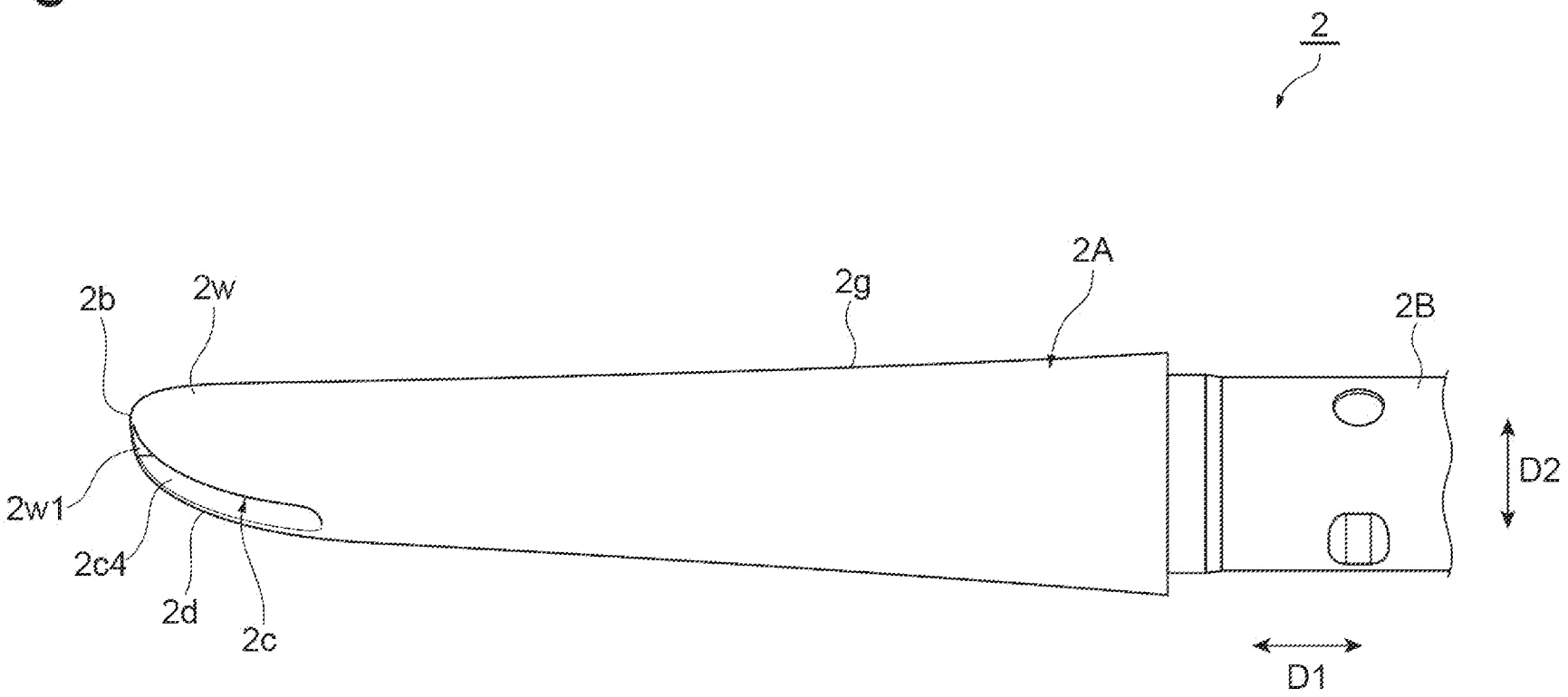
FIG. 8 is an enlarged perspective view of a leading cylinder of the application container in FIG. 1.

FIG. 8 is an enlarged perspective view of the front side cylindrical portion 2A of the leading cylinder 2. In FIG. 8, the application material M is omitted in the illustration. As illustrated in FIG. 8, the opening 2*c* of the leading cylinder 2 is defined by an inner surface 2*c*4 oriented in the minor axis direction D3. In addition, a second application material holder 2*w* that holds the application material M from one side in the major axis direction D2 is provided on one side (side opposite to the front edge 2*d*) of the opening 2*c* in the major axis direction D2. The second application material holder 2*w* has a facing surface 2*w*1 which the application material M faces inside the leading cylinder 2. For example, the facing surface 2*w*1 has a curved surface shape curved to bulge in the major axis direction D2. In addition, the application material insertion portion 2*r* of the leading cylinder 2 described above is defined by the inner surface 2*c*4 and the facing surface 2*w*1 of the leading cylinder 2.

Figure 9:
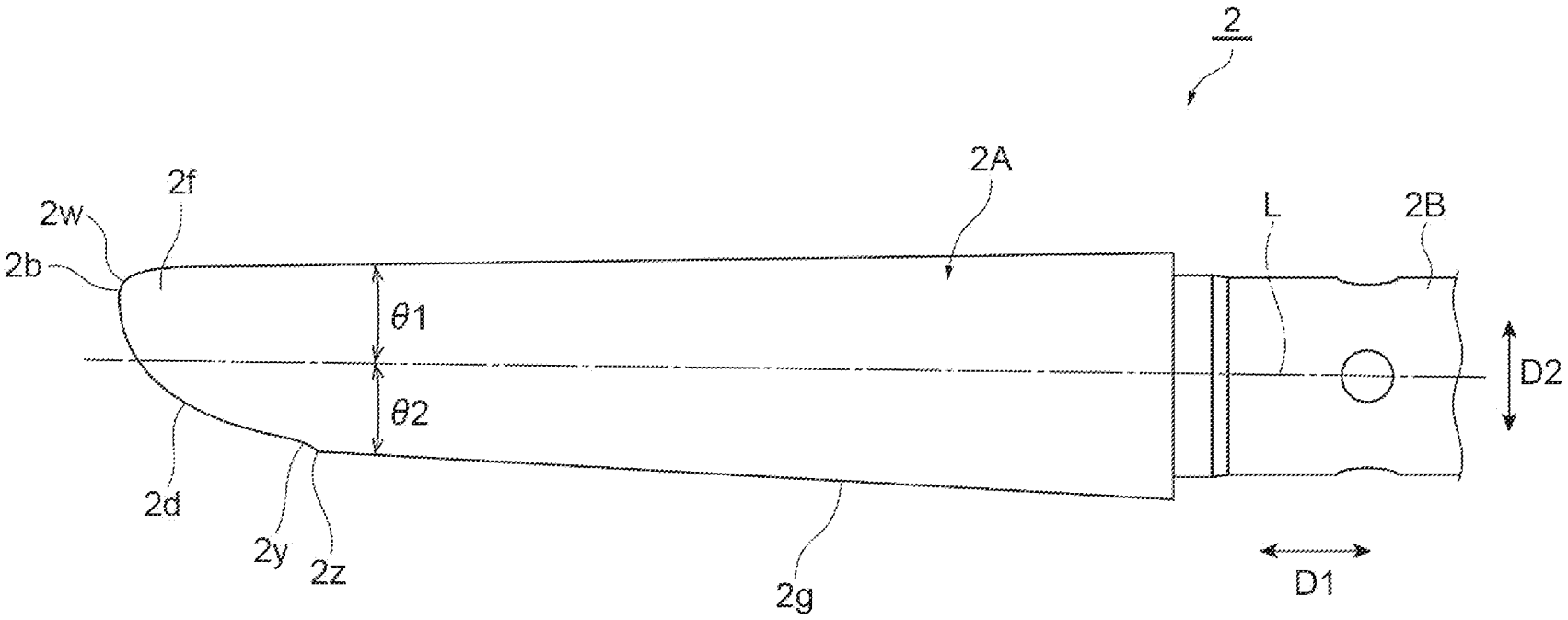
FIG. 9 is an enlarged side view of the leading cylinder of the application container in FIG. 1.

FIG. 9 is a side view illustrating the front side cylindrical portion 2A of the leading cylinder 2 when viewed in the minor axis direction D3. As illustrated in FIG. 9, an average inclination angle θ1 with respect to the axial direction D1 of the tapered surface 2*g* located on one side (side opposite to the front edge 2*d*) in the major axis direction D2 is smaller than an average inclination angle θ2 of the tapered surface 2*g* located on the other side (front edge 2*d* side) in the major axis direction D2.

For example, the average inclination angle θ1 is 0.5° to 3.0°. In addition, a lower limit of the average inclination angle θ1 may be 0.6° or 0.7°, and an upper limit of the average inclination angle θ1 may be 2.5° or 1.5°. As an example, the average inclination angle θ1 is 2.11°. For example, the average inclination angle θ2 is 2.5° to 5.0°. The lower limit of the average inclination angle θ2 may be 2.5° or 3.0°, and the upper limit of the average inclination angle θ2 may be 4.0° or 3.5°. As an example, the average inclination angle θ2 is 3.02°.

In the present disclosure, the "average inclination angle" indicates an average value of inclination angles of the tapered surface with respect to the axial direction at each position in the axial direction. That is, the inclination angle of the tapered surface with respect to the axial direction varies depending on the position in the axial direction. Accordingly, an average value of a plurality of inclination angles in each of a plurality of axial positions of lines formed by the tapered surface projected laterally (for example, in the minor axis direction) is defined as the "average inclination angle". When the tapered surface includes a curved surface and the curved surface is projected laterally (for example, in the minor axis direction) to form a curve, the average value of the inclination angles with respect to the axial direction of a tangent of the curve is used.

Figure 10:
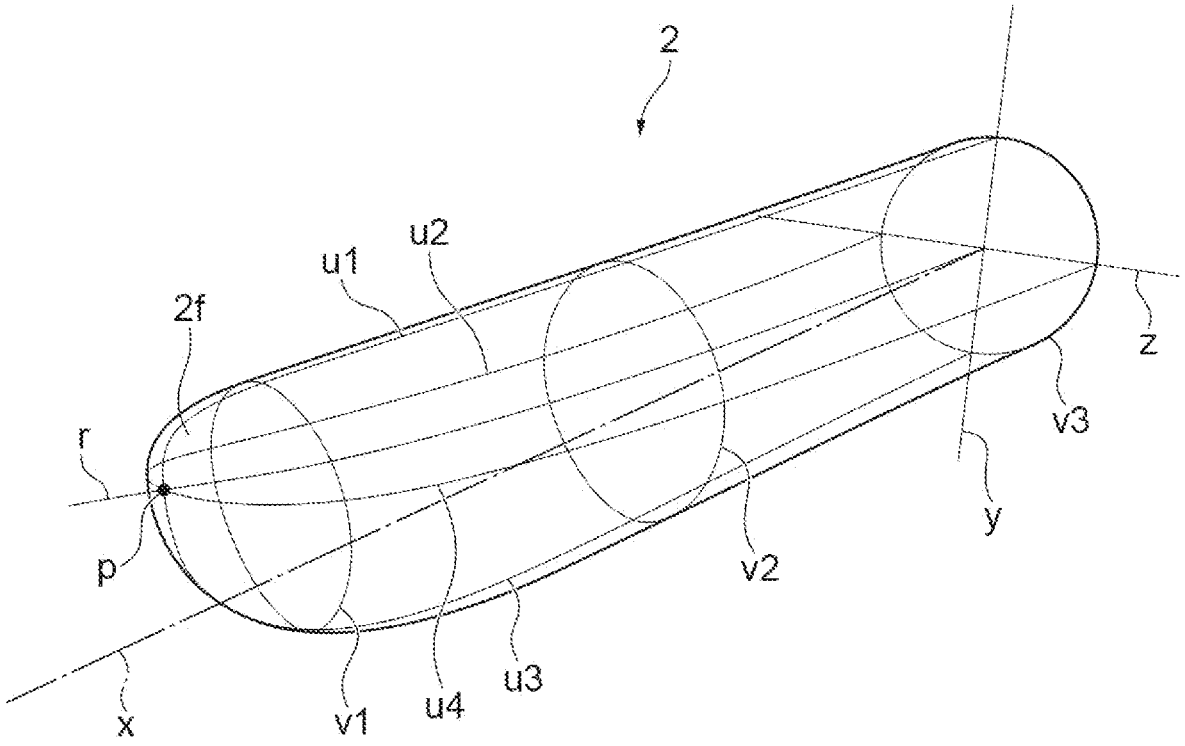
FIG. 10 illustrates a three-dimensional drawing method of the leading cylinder of the application container in FIG. 1.
Figure 11A:
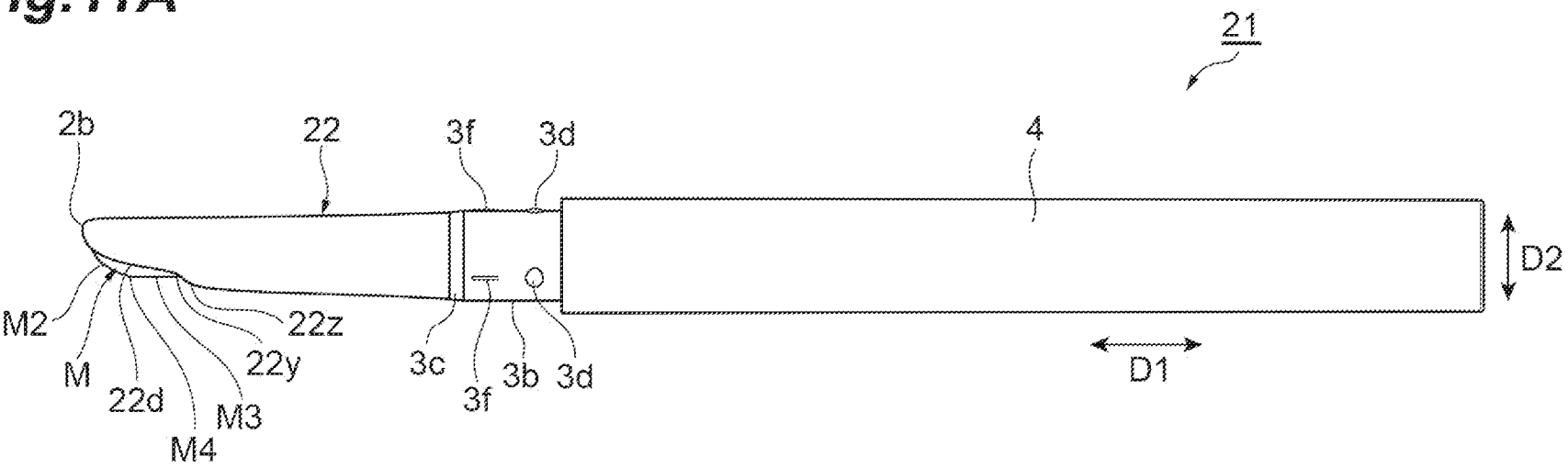
FIG. 11A is a side view illustrating another example application container.
Figure 11B:
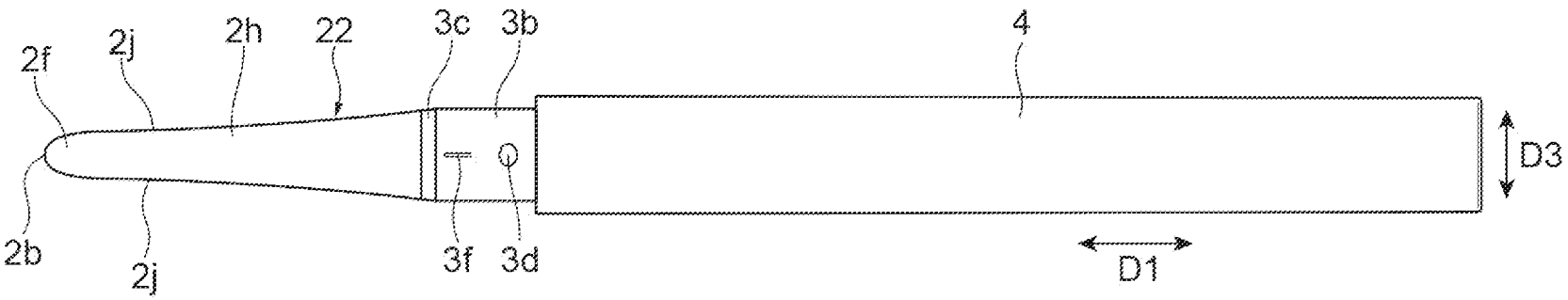
FIG. 11B is a side view illustrating another example application container.
Figure 12:
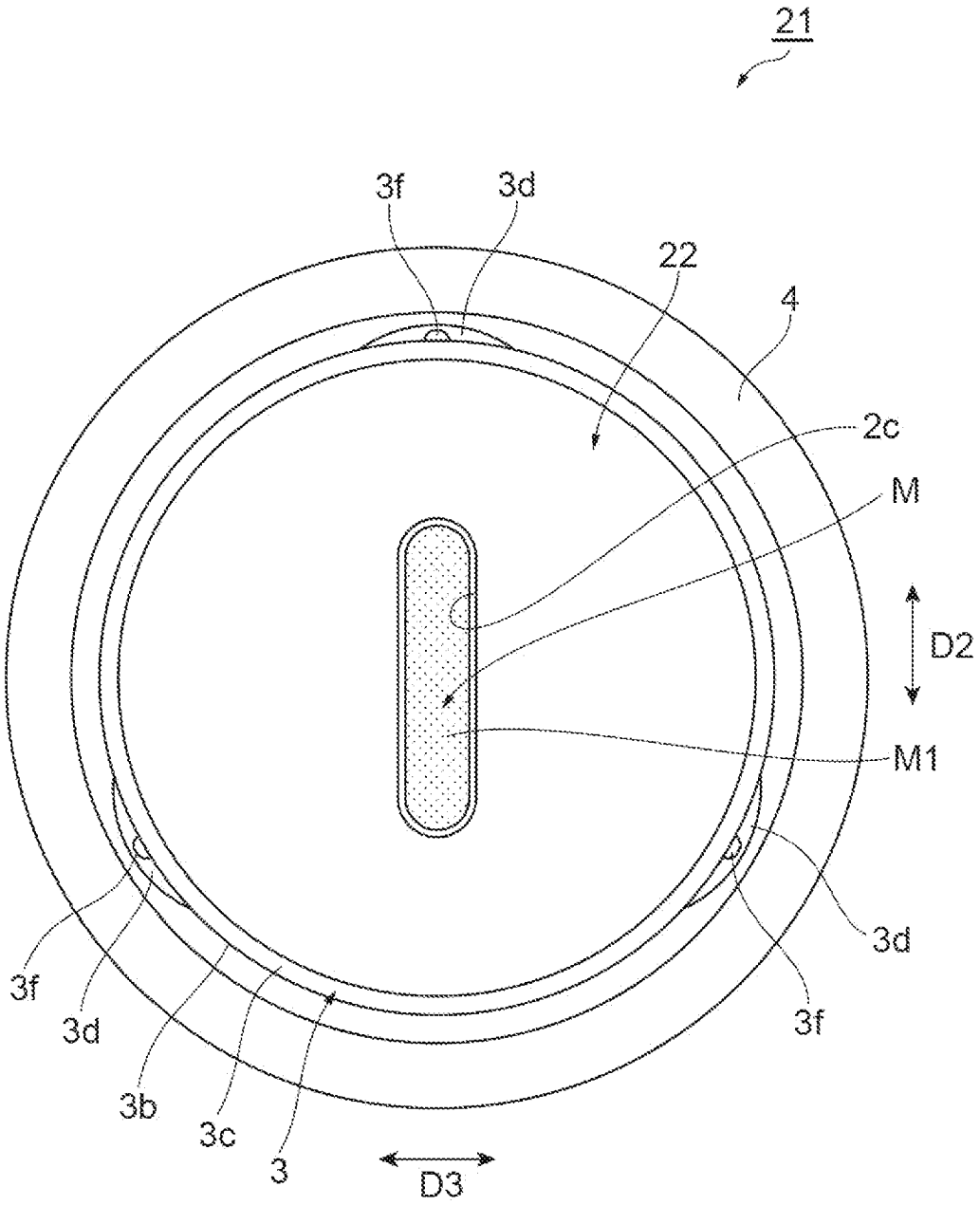
FIG. 12 is a front view of the application container in FIGS. 11A and 11B.
Figure 13:
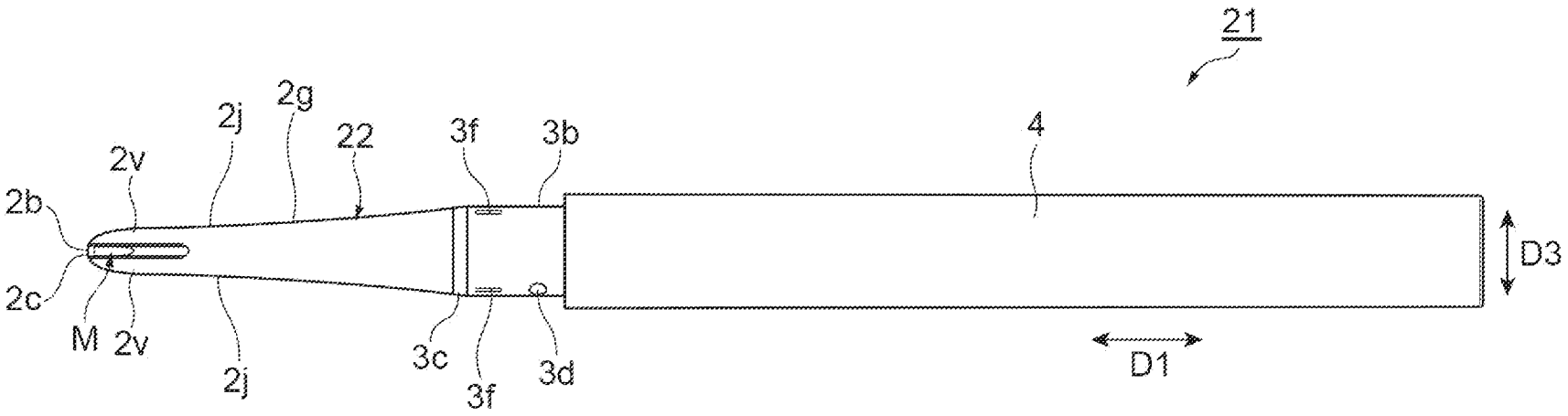
FIG. 13 is another side view of the application container in FIGS. 11A and 11B when viewed in a different direction.

Subsequently, a design of the shape of the leading cylinder 2 will be described with reference to FIG. 10. FIG. 10 illustrates an example of drawing the leading cylinder 2 by using a three-dimensional drawing method. In the three-dimensional drawing method, an x-axis extending in the axial direction D1, a y-axis extending in the major axis direction D2, and a z-axis extending in the minor axis direction D3 are set. First, a base end circle v3 having a diameter corresponding to a diameter of the leading cylinder 2 is drawn on a yz-plane (process for setting the diameter of the leading cylinder). The base end circle v3 corresponds to a circle indicating a portion on a side (base end side) opposite to the tip portion 2*f* of the leading cylinder 2.

Then, a point p is set as the tip 2*b* of the leading cylinder 2 at a location moved upward from the x-axis on an xy-plane (process for setting the tip of the leading cylinder). Curves u1, u2, u3, and u4 are drawn from the point p toward each of quadrants of the base end circle v3, thereby setting an outer shape of the leading cylinder 2 (process for setting the outer shape of the leading cylinder).

The curves u1, u2, u3, and u4 are curves curved to bulge to the outside of the leading cylinder 2, and for example, each radius of curvature of the curves u1, u2, u3, and u4 increases away from the point p. The radius of curvature of the curve u1 in the vicinity (for example, the tip portion 2*f*) of the point p is smaller than each of the radii of curvature of the curves u2, u3, or u4 in the vicinity of the point p. The radius of curvature of the curve u3 in the vicinity of the point p is larger than each of the radii of curvature of the curve u2 or the curve u4 in the vicinity of the point p. In addition, the radius of curvature of the curve u2 in the vicinity of the point p may be the same as the radius of curvature of the curve u4 in the vicinity of the point p. The curve u2 and the curve u4 may be drawn to be mutually symmetrical with respect to the xy-plane.

A closed curve v1 and a closed curve v2 which pass through the curve u1, the curve u2, the curve u3, and the curve u4 are drawn in each intermediate portion of the curve u1, the curve u2, the curve u3, and the curve u4 which extend from the point p to each of the quadrants of the base end circle v3, thereby adjusting the outer shape of the leading cylinder 2 (process for adjusting the outer shape of the leading cylinder). Then, a curved surface obtained by drawing the curve u1, the curve u2, the curve u3, the curve u4, the curve v1, the curve v2, and the base end circle v3 as guides is set as a surface shape of the leading cylinder 2 (process for setting the surface shape of the leading cylinder).

The shape of the leading cylinder 2 can be drawn through the above-described respective processes. For example, a dome shape of the tip portion 2*f* of the leading cylinder 2 corresponds to a dome shape in which a dome-shaped curved surface having a round tip of a parabolic surface obtained by rotating a parabola around the x-axis is biased and deformed to one side (upward in FIG. 10) from the x-axis.

Next, an example operational effect obtained from the application container 1 will be described in detail. As illustrated in FIGS. 1, 3, 6A, and 6B, the application container 1 includes a leading cylinder 2 that contains the flat and solid application material M. Therefore, a thin line can be drawn by the flat application material M.

The opening 2*c* of the leading cylinder 2 extends in the major axis direction D2 and the minor axis direction D3. The leading cylinder 2 has the front edge 2*d* curved to bulge to the outside of the leading cylinder 2 from the tip 2*b* located on one side in the major axis direction D2 toward the other side in the major axis direction D2 and the rear side. The leading cylinder 2 has the tip portion 2*f* curved to bulge forward toward the tip 2*b* when viewed from one side in the major axis direction D2. Therefore, the front edge 2*d* and the tip portion 2*f* are curved to bulge in order to reduce discomfort felt by a user when the front edge 2*d* or the tip portion 2*f* comes into contact with the skin.

When viewed from the other side in the major axis direction D2, the opening 2*c* extends rearward in a slit shape from the tip 2*b*. Therefore, since the application material M is exposed from the opening 2*c* extending in the slit shape, a thin line can be readily drawn by the application material M.

In addition, the first application material holder 2*v* is formed on each of one side and the other side (i.e., on opposite sides) in the minor axis direction D3 when viewed from the slit-shaped opening 2*c*. Therefore, the application material M exposed from the slit-shaped opening 2*c* can be held from both sides in the minor axis direction D3 by the first application material holder 2*v* in order to prevent the breakage of the flat application material M. In addition, each of the pair of first application material holders 2*v* extends rearward while being curved to bulge to the outside of the leading cylinder 2 from the tip 2*b* of the leading cylinder 2 in order to reduce the discomfort felt by the user when the first application material holder 2*v* comes into contact with the skin.

As illustrated in FIG. 8, the application container 1 may include the second application material holder 2*w* located on one side in the major axis direction D2 of the opening 2*c* extending in the slit shape. In some examples, the application material M can be held from one side in the major axis direction D2 by the second application material holder 2*w* in order to more reliably prevent the breakage of the application material M.

As illustrated in FIGS. 2 and 6B, the length N1 of the opening 2*c* in the axial direction D1 when viewed from the other side in the major axis direction D2 may be equal to or longer than the length N2 of the opening 2*c* in the major axis direction D2 when viewed from the front. In some examples, the length N1 of the application material M exposed from the opening 2*c* extending in the slit shape to the side of the leading cylinder 2 is long. Accordingly, a thin line can be readily drawn while the application container 1 is inclined with respect to the application target portion.

In some examples, in the opening 2*c* extending rearward in the slit shape from the tip 2*b* of the leading cylinder 2, the length N1 of the opening 2*c* when viewed from the other side in the major axis direction D2 is equal to or longer than the length N2 of the opening 2*c* when viewed from the front. Accordingly, a thin line can be freely drawn while the application container 1 is inclined by laying down or erecting the application container 1. In addition, even in a state where the application container 1 is inclined with respect to the application target portion (state where the axis L of the application container 1 is inclined with respect to a direction orthogonal to an application target surface of the application target portion), the thin line can be freely drawn. Accordingly, the thin line can be readily drawn at various inclination angles.

As illustrated in FIG. 9, the leading cylinder 2 has the body portion 2*h* having the tapered surface 2*g* extending rearward from the tip portion 2*f* and inclined so that the width of the leading cylinder 2 increases rearward when viewed in the minor axis direction D3. When viewed in the minor axis direction D3, the average inclination angle θ2 of the tapered surface 2*g* located on the other side in the major axis direction D2 with respect to the axis L may be larger than the average inclination angle θ1 of the tapered surface 2*g* located on one side in the major axis direction D2 with respect to the axis L. In some examples, the average inclination angle θ2 of the tapered surface 2*g* on the side of the opening 2*c* extending in the slit shape is large. Accordingly, the application material M exposed from the opening 2*c* provided along the tapered surface 2*g* having the large average inclination angle θ2 is brought into contact with the application target portion. In this manner, a thin line can be readily drawn while the application container 1 is inclined.

As illustrated in FIG. 5, the center position (central axis X) of the opening 2*c* when viewed from the front may be biased to the other side in the major axis direction D2 from the axis L. In some examples, since the opening 2*c* extending in the slit shape is biased to the other side in the major axis direction D2, a thin line can be readily drawn by the application material M exposed from the opening 2*c*.

As illustrated in FIG. 4, the leading cylinder 2 has the body portion 2*h* having the tapered surface 2*g* extending rearward from the tip portion 2*f* and inclined so that the width of the leading cylinder 2 increases rearward. The tapered surface 2*g* may include the recess portion 2*j* curved to be recessed. In some examples, since the tapered surface 2*g* includes the recess portion 2*j*, a portion of the body portion 2*h* can be thinned. Accordingly, the body portion 2*h* can be less likely to interfere with a line of sight of a user when the application is performed. In addition, since the body portion 2*h* includes the recess portion 2*j* on the tapered surface 2*g*. Accordingly, a wall thickness of the leading cylinder 2 can be approximately constant in order to prevent a sink mark that may occur when the leading cylinder 2 is molded.

The recess portion 2*j* may be curved to be recessed when the leading cylinder 2 is viewed along the major axis direction D2. In this case, the recess portion 2*j* is visible in a state of being recessed when the leading cylinder 2 is viewed along the major axis direction D2. Accordingly, a user can readily recognize the minor axis direction D3 of the leading cylinder 2 with a finger touch. Therefore, the user can feel that the application container 1 is easy to hold. Accordingly, usability of the application container 1 can be improved.

It is to be understood that not all aspects, advantages and features described herein may necessarily be achieved by, or included in, any one particular example. Indeed, having described and illustrated various examples herein, it should be apparent that other examples may be modified in arrangement and detail.

For example, another example application container 21 will be described with reference to FIGS. 11A, 11B, 12, and 13. The application container 21 is different from the above-described application container 1 in that the application material M protrudes from a leading cylinder 22 in an initial state (for example, a state where the cap is detached for the first time). In some examples, the shape of the leading cylinder 22 is different from the shape of the leading cylinder 2 of the application container 1.

When viewed in the minor axis direction D3, the front edge 22*d* of the leading cylinder 22 is curved inward in the major axis direction D2 of the leading cylinder 22 from respect to the curved portion M2 of the application material M. That is, the front edge 22*d* and the curved portion M2 are not parallel to each other, and the front edge 22*d* is curved inward of the leading cylinder 22 from the curved portion M2. Accordingly, the application material M is exposed in the initial state. For example, the leading cylinder 22 has a recess portion 22*y* recessed inward of the leading cylinder 22 on the rear side of the front edge 22*d*, and a projection portion 22*z* located behind the recess portion 22*y*.

The leading cylinder 22 has the first application material holders 2*v* respectively formed on one side and the other side in the minor axis direction D3 when viewed from the opening 2*c*. The application material M exposed from the opening 2*c* of the leading cylinder 22 can be held from both sides in the minor axis direction D3 by the pair of first application material holders 2*v* in order to prevent the breakage of the application material M. In addition, in the application container 21 according to the modification example, the application material M protrudes from the leading cylinder 22 in the initial state. Accordingly, the application material M can be immediately applied by detaching the cap, thereby contributing to further improved usability.

The application container can be further modified. For example, in some of the above-described examples, the pair of first application material holders 2*v* aligned along the minor axis direction D3 is disposed to be mutually symmetrical with respect to the opening 2*c*. However, the pair of first application material holders may not be disposed to be mutually symmetrically with respect to the opening. The shape and the size of the first application material holder can be appropriately changed within the scope of the above-described concept. The same applies to the second application material holder.

In addition, the example application container 1 has been described which includes the feeding mechanism 10 for feeding the application material M forward by the relative rotation between the leading cylinder 2 and the middle cylinder 3. However, the feeding mechanism of the application container may be modified to include, for example, a knock-type mechanical extrusion mechanism or a squeeze-type extrusion mechanism instead of the feeding mechanism.

In addition, some examples have been described in which the application material M is the eyebrow liner and the application container 1 is the eyebrow feeding container. However, the application container is also applicable to various application materials such as an eyeliner, a concealer, or a lip liner. Furthermore, the application container is also applicable to a writing instrument, a design pencil, and a drawing material.

What is claimed is:

1. An application container comprising:

a main body; and a leading cylinder attached to the main body and configured to contain an application material, the leading cylinder having an axial direction and an opening in the axial direction through which the application material is exposed, wherein when viewed from a front of the leading cylinder, the opening has a first length which extends in a major axis direction intersecting with the axial direction, and has a second length which extends in a minor axis direction intersecting with both the axial direction and the major axis direction, the leading cylinder has a curved front edge forming a bulged portion that curves from a tip of the leading cylinder located on a first side of the leading cylinder in the major axis direction toward a second side of the leading cylinder in the major axis direction, and curves rearward when viewed in the minor axis direction, and when viewed from the second side of the leading cylinder in the major axis direction, the opening extends rearward from the tip of the leading cylinder in a slit shape, and a first application material holder located on opposite sides of the opening in the minor axis direction is formed in a tip portion of the leading cylinder having curved outer surface extending rearward to form a bulge that curves from the tip to an outer surface of the leading cylinder.

2. The application container according to claim 1, further comprising:

a second application material holder located on one side of the opening in the major axis direction.

3. The application container according to claim 1, wherein an axial length of the opening in the axial direction when viewed from the second side in the major axis direction is equal to or longer than the first length of the opening in the major axis direction when viewed from the front of the leading cylinder.

4. The application container according to claim 1, wherein the leading cylinder includes a body portion having a tapered surface that extends rearward from the tip portion and is inclined so that a width of the leading cylinder increases rearward when viewed in the minor axis direction, and when viewed in the minor axis direction, an average inclination angle of the tapered surface located on the second side of the leading cylinder in the major axis direction is larger than an average inclination angle of the tapered surface located on the first side of the leading cylinder in the major axis direction.

5. The application container according to claim 1, wherein a center position of the opening when viewed from the front of the leading cylinder is biased from the axis to the second side in the major axis direction.

6. The application container according to claim 1, wherein the leading cylinder includes a body portion having a tapered surface that extends rearward from the tip portion and is inclined so that a width of the leading cylinder increases rearward, and the tapered surface includes a recessed portion.

7. The application container according to claim 6, wherein the recessed portion appears to be recessed when the leading cylinder is viewed along the major axis direction.

* * * * *